US009903353B2

(12) United States Patent
Honda et al.

(10) Patent No.: US 9,903,353 B2
(45) Date of Patent: Feb. 27, 2018

(54) VARIABLE DISPLACEMENT SWASH PLATE COMPRESSOR

(71) Applicant: KABUSHIKI KAISHA TOYOTA JIDOSHOKKI, Aichi-ken (JP)

(72) Inventors: Kazunari Honda, Kariya (JP); Takahiro Suzuki, Kariya (JP); Hideharu Yamashita, Kariya (JP); Hiromichi Ogawa, Kariya (JP); Shohei Fujiwara, Kariya (JP)

(73) Assignee: KABUSHIKI KAISHA TOYOTA JIDOSHOKKI, Aichi-Ken (JP)

( * ) Notice: Subject to any disclaimer, the term of this patent is extended or adjusted under 35 U.S.C. 154(b) by 244 days.

(21) Appl. No.: 14/666,846

(22) Filed: Mar. 24, 2015

(65) Prior Publication Data

US 2015/0275877 A1 Oct. 1, 2015

(30) Foreign Application Priority Data

Mar. 28, 2014 (JP) ..... 2014-070184

(51) Int. Cl.

| | |
|---|---|
| ***F04B 27/18*** | (2006.01) |
| ***F04B 27/08*** | (2006.01) |
| ***F04B 27/12*** | (2006.01) |
| ***F04B 39/00*** | (2006.01) |
| ***F04B 39/10*** | (2006.01) |

(Continued)

(52) U.S. Cl.

CPC ..... *F04B 27/1804* (2013.01); *F04B 27/0878* (2013.01); *F04B 27/1036* (2013.01); *F04B 27/1054* (2013.01); *F04B 27/1063* (2013.01); *F04B 27/1072* (2013.01); *F04B 27/12* (2013.01); *F04B 39/0027* (2013.01);

(Continued)

(58) Field of Classification Search

None

See application file for complete search history.

(56) References Cited

U.S. PATENT DOCUMENTS

| | | | |
|---|---|---|---|
| 4,037,993 | A | 7/1977 | Roberts |
| 4,061,443 | A | 12/1977 | Black et al. |

(Continued)

FOREIGN PATENT DOCUMENTS

| | | |
|---|---|---|
| CN | 103807132 | 5/2014 |
| CN | 103807134 | 5/2014 |

(Continued)

OTHER PUBLICATIONS

Extended European Search Report for EP App. No. 15160831.2 dated Nov. 13, 2015.

(Continued)

*Primary Examiner* — Peter J Bertheaud
*Assistant Examiner* — Geoffrey Lee
(74) *Attorney, Agent, or Firm* — Greenblum & Bernstein, P.L.C.

(57) ABSTRACT

An actuator of a variable displacement swash compressor includes a partitioning body that is movable along the axis of a drive shaft, a movable body that changes the inclination angle of a swash plate, and a control pressure chamber defined by the partitioning body and the movable body. The movable body is moved by drawing refrigerant in the control pressure chamber from a discharge chamber. The swash plate is configured to contact and move the partitioning body as the inclination angle increases.

8 Claims, 9 Drawing Sheets

(51) Int. Cl.
*F04B 39/12* (2006.01)
*F04B 27/10* (2006.01)

(52) U.S. Cl.
CPC ..... *F04B 39/10* (2013.01); *F04B 39/121* (2013.01); *F04B 39/123* (2013.01)

(56) References Cited

U.S. PATENT DOCUMENTS

| | | | | |
|---|---|---|---|---|
| 4,174,191 | A | 11/1979 | Roberts | |
| 4,606,705 | A * | 8/1986 | Parekh | F04B 27/1804 417/222.2 |
| 4,884,952 | A | 12/1989 | Kanamaru et al. | |
| 4,946,350 | A * | 8/1990 | Suzuki | F04B 27/1804 417/222.2 |
| 4,963,074 | A | 10/1990 | Sanuki et al. | |
| 5,032,060 | A | 7/1991 | Kobayashi et al. | |
| 5,186,475 | A | 2/1993 | Kawai et al. | |
| 5,259,736 | A | 11/1993 | Terauchi | |
| 5,370,503 | A | 12/1994 | Terauchi | |
| 5,636,973 | A * | 6/1997 | Sonobe | F04B 27/1804 417/222.2 |
| 5,871,337 | A * | 2/1999 | Fukanuma | F04B 39/1073 417/222.2 |
| 6,077,047 | A | 6/2000 | Nagai et al. | |
| 6,126,405 | A * | 10/2000 | Kawaguchi | F04B 27/1804 417/222.2 |
| 6,135,722 | A * | 10/2000 | Kawaguchi | F04B 27/1063 417/222.2 |
| 6,139,282 | A | 10/2000 | Ota et al. | |
| 6,149,398 | A | 11/2000 | Fukanuma et al. | |
| 6,158,968 | A | 12/2000 | Nakamura | |
| 6,227,812 | B1 * | 5/2001 | Kawaguchi | F04B 27/1804 417/222.2 |
| 6,250,891 | B1 * | 6/2001 | Kawaguchi | F04B 27/1054 417/222.2 |
| 6,379,120 | B1 | 4/2002 | Adaniya et al. | |
| 6,520,751 | B2 * | 2/2003 | Fujita | F04B 27/1804 137/513.3 |
| 6,546,742 | B1 * | 4/2003 | Ota | B60H 1/3208 62/133 |
| 6,848,262 | B2 * | 2/2005 | Nosaka | B60H 1/3208 417/222.2 |
| 6,957,604 | B1 | 10/2005 | Tiedemann et al. | |
| 7,530,797 | B2 * | 5/2009 | Ito | F04B 27/1063 417/222.1 |
| 7,841,839 | B2 * | 11/2010 | Inoue | F04B 27/1081 417/213 |
| 8,596,994 | B2 * | 12/2013 | Taguchi | F04B 27/1081 137/512.1 |
| 9,228,576 | B2 * | 1/2016 | Yamamoto | F04B 27/18 |
| 9,228,577 | B2 | 1/2016 | Yamamoto et al. | |
| 9,309,874 | B2 | 4/2016 | Yamamoto et al. | |
| 9,309,875 | B2 | 4/2016 | Yamamoto et al. | |
| 9,316,217 | B2 * | 4/2016 | Yamamoto | F04B 27/1804 |
| 9,429,147 | B2 | 8/2016 | Suzuki et al. | |
| 9,506,459 | B2 * | 11/2016 | Ota | F04B 27/18 |
| 2002/0006339 | A1 * | 1/2002 | Ota | F04B 27/1081 417/222.2 |
| 2003/0223887 | A1 | 12/2003 | Kawano et al. | |
| 2004/0062660 | A1 * | 4/2004 | Kazahaya | F04B 27/1804 417/222.1 |
| 2009/0107327 | A1 | 4/2009 | Ota et al. | |
| 2014/0127042 | A1 | 5/2014 | Yamamoto et al. | |
| 2014/0127045 | A1 | 5/2014 | Yamamoto et al. | |
| 2014/0294613 | A1 | 10/2014 | Suzuki et al. | |
| 2014/0294614 | A1 | 10/2014 | Ota et al. | |
| 2015/0285234 | A1 | 10/2015 | Nakaima et al. | |

FOREIGN PATENT DOCUMENTS

| | | |
|---|---|---|
| EP | 2728186 | 5/2014 |
| EP | 2784316 | 10/2014 |
| JP | 52-131204 | 11/1977 |
| JP | 62-225782 | 10/1987 |
| JP | 62-247184 | 10/1987 |
| JP | 2-19665 | 1/1990 |
| JP | 5-172052 | 7/1993 |
| JP | 10-246181 | 9/1998 |
| JP | 4378190 | 12/2009 |
| KR | 10-1992-0021904 | 12/1992 |
| WO | 2014/069618 | 5/2014 |

OTHER PUBLICATIONS

Extended European Search Report for EP App. No. 15160830.4 dated Nov. 13, 2015.
Extended European Search Report for EP App. No. 15160833.8 dated Nov. 13, 2015.
Search Report for EP Pat. App. No. 15160832.0 dated Nov. 13, 2015.
Official Action, along with English-language translation thereof, for CN Appl. No. 201510133584.4 dated Aug. 2, 2016.
Official Action, along with English-language translation thereof, for CN Appl. No. 201510133583 dated Aug. 17, 2016.
Official Action in KR Appl. No. 10-2015-0040798 dated Nov. 21, 2016.
Official Action in KR Appl. No. 10-2015-0040736 dated Nov. 21, 2016.
Official Action in KR Appl. No. 10-2015-0040836 dated Nov. 24, 2016.
Official Action in KR Appl. No. 10-2015-0040839 dated Nov. 29, 2016.
U.S. Appl. No. 14/666,860 to Shinya Yamamoto et al., filed Mar. 24, 2015.
U.S. Appl. No. 14/666,819 to Shinya Yamamoto et al., filed Mar. 24, 2015.
U.S. Appl. No. 14/666,759 to Shinya Yamamoto et al., filed Mar. 24, 2015.
U.S. Appl. No. 14/666,688 to Shinya Yamamoto et al., filed Mar. 24, 2015.
U.S. Appl. No. 14/666,639 to Shinya Yamamoto et al., filed Mar. 24, 2015.
Official Action for CN Appl. No. 201510134293.7 dated Aug. 17, 2016.
Official Action issued in U.S. Appl. No. 14/666,688 dated Jan. 27, 2017.
Official Action issued in U.S. Appl. No. 14/666,860 dated Feb. 9, 2017.
Official Action issued in U.S. Appl. No. 14/666,819 dated Mar. 24, 2017.
Official Action issued in U.S. Appl. No. 14/666,639 dated Apr. 6, 2017.
Official Action issued in U.S. Appl. No. 14/666,759 dated Apr. 18, 2017.

* cited by examiner

Up
Down
Front
Rear
O

Up
Rear
Front
Down

Up
Front
Rear
Down

VARIABLE DISPLACEMENT SWASH PLATE COMPRESSOR

BACKGROUND OF THE INVENTION

The present invention relates to a variable displacement swash plate compressor.

Japanese Laid-Out Patent Publication No. 5-172052 describes a conventional variable displacement swash plate compressor (hereafter simply referred to as the compressor). The compressor has a housing including a front housing member, a cylinder block, and a rear housing member. The front housing member and the rear housing member each includes a suction chamber and a discharge chamber. The cylinder block includes a swash plate chamber and cylinder bores. A rotatable drive shaft is supported in the housing. A swash plate that is rotatable together with the drive shaft is arranged in the swash plate chamber. A link mechanism is located between the drive shaft and the swash plate to allow the inclination angle of the swash plate to change. The inclination angle refers to an angle of the swash plate relative to a plane orthogonal to the rotation axis of the drive shaft. Each cylinder bore accommodates a reciprocal piston. Two shoes are provided for each piston to serve as a conversion mechanism that uses the rotation of the swash plate to reciprocate the piston in the corresponding cylinder bore with a stroke that is in accordance with the inclination angle of the swash plate. An actuator, which includes a movable body and a control pressure chamber, changes the inclination angle of the swash plate. A control mechanism regulates the pressure of the control pressure chamber to control the actuator.

The link mechanism includes a lug arm, first and second arms, and a movable body. The lug arm is fixed to the drive shaft and located in front of the swash plate chamber. The first arm is located on the front surface of the swash plate, and the second arm is located on the rear surface of the swash plate. The first arm pivotally couples the lug arm and the swash plate. The second arm pivotally couples the movable body and the swash plate.

In the compressor, the control mechanism increases the pressure of the control pressure chamber with the pressure of the refrigerant in the discharge chamber to move the movable body toward the swash plate along the axis of the drive shaft. As a result, the movable body pushes the swash plate and increases the inclination angle of the swash plate. The swash plate comes into contact with the lug arm when the inclination angle of the swash plate becomes maximal. This allows the compressor displacement to be maximized for each rotation of the drive shaft.

In the conventional compressor described above, contact of the swash plate and the lug arm restricts the swash plate at the maximum inclination angle. The lug arm is fixed to the drive shaft. Thus, contact of the swash plate and the lug arm may produce an impact that generates vibration and lowers the durability of the compressor. Further, contact of the swash plate and the lug arm produces noise. Such situations become further noticeable when quickly increasing the compressor displacement to the maximum amount.

SUMMARY OF THE INVENTION

It is an object of the present invention to provide a durable compressor with noise reduced.

One aspect of the present invention is a variable displacement swash plate compressor provided with a housing including a suction chamber, a discharge chamber, a swash plate chamber, and a cylinder bore. A drive shaft is rotationally supported by the housing. A swash plate is rotatable together with the drive shaft in the swash plate chamber. A link mechanism is arranged between the drive shaft and the swash plate. The link mechanism includes a supporting portion that pivotally supports the swash plate, and the link mechanism allows for changes in an inclination angle of the swash plate relative to a plane orthogonal to an axis of the drive shaft. A piston is reciprocally accommodated in the cylinder bore. A conversion mechanism is configured to reciprocate the piston in the cylinder bore with a stroke that is in accordance with the inclination angle of the swash plate when the swash plate rotates. An actuator is located in the swash plate chamber. The actuator is capable of changing the inclination angle of the swash plate. A control mechanism is configured to control the actuator. The actuator includes a partitioning body arranged on the drive shaft. The partitioning body is movable along the axis of the drive shaft. A movable body is arranged on the drive shaft. The movable body includes a coupling portion coupled to the swash plate, and the movable body moves in contact with the partitioning body along the axis of the drive shaft to change the inclination angle of the swash plate. A control pressure chamber is defined by the partitioning body and the movable body. The movable body is moved by drawing refrigerant in the control pressure chamber from the discharge chamber. The swash plate is configured to contact and move the partitioning body as the inclination angle increases.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE EMBODIMENTS

First and second embodiments of the present invention will now be described with reference to the drawings. Each compressor of the first and second embodiments is a variable displacement compressor that employs double-headed pistons and a swash plate. The compressor is installed in a vehicle to form a refrigeration circuit of a vehicle air conditioner.

First Embodiment

Figure 1:
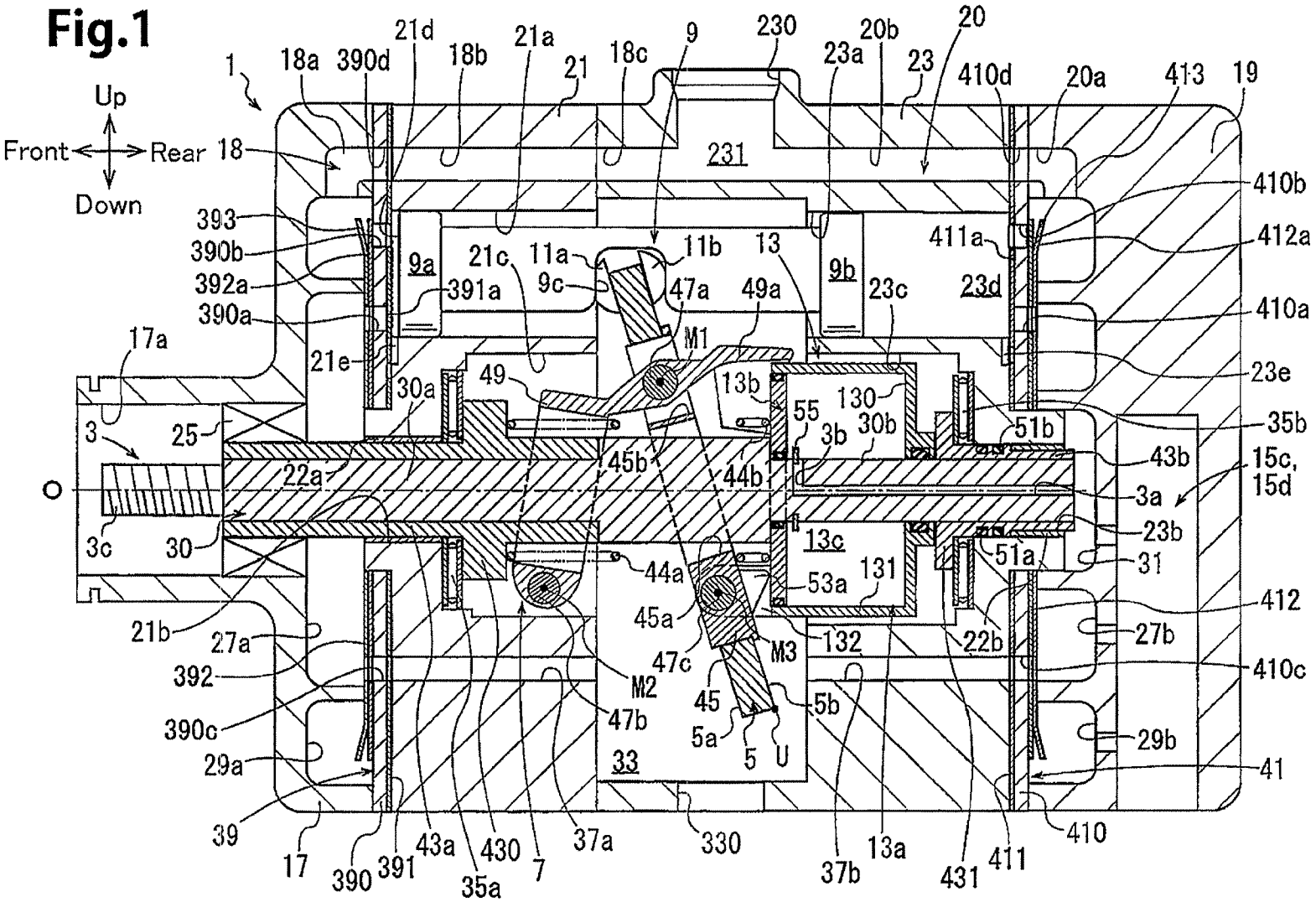
FIG. 1 is a cross-sectional view showing a compressor of a first embodiment when the displacement is maximal.
Figure 2:
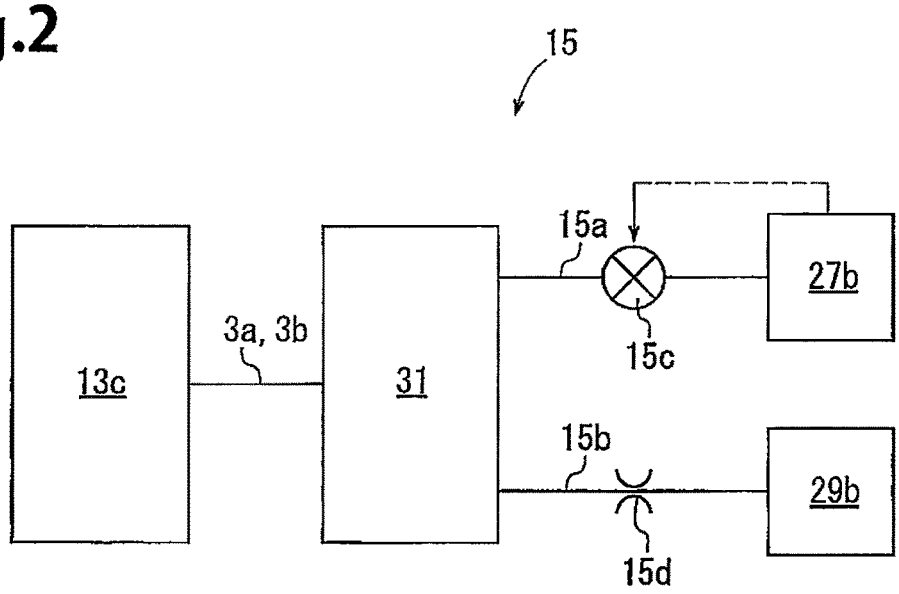
FIG. 2 is a schematic diagram showing a control mechanism in the compressor of FIG. 1.

Referring to FIG. 1, a compressor of the first embodiment includes a housing 1, a drive shaft 3, a swash plate 5, a link mechanism 7, pistons 9, front and rear shoes 11*a* and 11*b*, an actuator 13, and a control mechanism 15, which is shown in FIG. 2. Each piston 9 is provided with a pair of the shoes 11*a* and 11*b*.

As shown in FIG. 1, the housing 1 includes a front housing member 17, which is located at the front of the compressor, a rear housing member 19, which is located at the rear of the compressor, first and second cylinder blocks 21 and 23, which are located between the front housing member 17 and the rear housing member 19, and first and second valve formation plates 39 and 41.

The front housing member 17 includes a boss 17*a*, which projects toward the front. A sealing device 25 is arranged in the boss 17*a*. Further, the front housing member 17 includes a first suction chamber 27*a* and a first discharge chamber 29*a*. The first suction chamber 27*a* is located in a radially inner portion of the front housing member 17, and the first discharge chamber 29*a* is annular and is located in a radially outer portion of the front housing member 17.

The front housing member 17 includes a first front communication passage 18*a*. The first front communication passage 18*a* includes a front end that is in communication with the first discharge chamber 29*a* and a rear end that opens at the rear end of the front housing member 17.

The rear housing member 19 includes the control mechanism 15 shown in FIG. 2. The rear housing member 19 includes a second suction chamber 27*b*, a second discharge chamber 29*b*, and a pressure regulation chamber 31. The pressure regulation chamber 31 is located in a radially central portion of the rear housing member 19. The second suction chamber 27*b* is annular and located at a radially outer side of the pressure regulation chamber 31 in the rear housing member 19. The second discharge chamber 29*b* is also annular and located at a radially outer side of the second suction chamber 27*b* in the rear housing member 19.

The rear housing member 19 includes a first rear communication passage 20*a*. The first rear communication passage 20*a* includes a rear end that is in communication with the second discharge chamber 29*b* and a front end that opens at the front end of the rear housing member 19.

A swash plate chamber 33 is defined in the first cylinder block 21 and the second cylinder block 23. The swash plate chamber 33 is located in an axially middle portion of the housing 1.

The first cylinder block 21 includes first cylinder bores 21*a*, which are arranged at equal angular intervals in the circumferential direction and which extend parallel to one another. Further, the first cylinder block 21 includes a first shaft bore 21*b*. The drive shaft 3 extends through the first shaft bore 21*b*. A first plain bearing 22*a* is arranged in the first shaft bore 21*b*.

The first cylinder block 21 also includes a first recess 21*c*, which is in communication and coaxial with the first shaft bore 21*b*. The first recess 21*c* is in communication with the swash plate chamber 33 and forms a portion of the swash plate chamber 33. A first thrust bearing 35*a* is arranged in a front portion of the first recess 21*c*. Further, the first cylinder block 21 includes a first communication passage 37*a* that communicates the swash plate chamber 33 with the first suction chamber 27*a*. The first cylinder block 21 also includes a first retainer groove 21*e*, which restricts the maximum open degree of first suction reed valves 391*a*, which will be described later.

The first cylinder block 21 includes a second front communication passage 18*b*. The second front communication passage 18*b* includes a front end that opens at the front end of the first cylinder block 21 and a rear end that opens at the rear end of the first cylinder block 21.

In the same manner as the first cylinder block 21, the second cylinder block 23 includes second cylinder bores 23*a*. Each second cylinder bore 23*a* is paired and axially aligned with one of the first cylinder bores 21*a*. The first cylinder bores 21*a* and the second cylinder bores 23*a* have the same diameter.

The second cylinder block 23 includes a second shaft bore 23*b*. The drive shaft 3 extends through the second shaft bore 23*b*. The second shaft bore 23*b* includes a second plain bearing 22*b*. The first and second plain bearings 22*a* and 22*b* may be replaced by ball bearings.

The second cylinder block 23 also includes a second recess 23*c*, which is in communication and coaxial with the second shaft bore 23*b*. Further, the second recess 23*c* is also in communication with the swash plate chamber 33 and forms a portion of the swash plate chamber 33. A second thrust bearing 35*b* is arranged in a rear portion of the second recess 23*c*. The second cylinder block 23 includes a second communication passage 37*b* that communicates the swash plate chamber 33 with the second suction chamber 27*b*. The second cylinder block 23 also includes a second retainer groove 23*e*, which restricts the maximum open degree of first suction reed valves 411*a*, which will be described later.

The second cylinder block 23 includes a discharge port 230, a converging discharge chamber 231, a third front communication passage 18*c*, a second rear communication passage 20*b*, and a suction port 330. The discharge port 230 is in communication with the converging discharge chamber 231. The discharge port 230 connects the converging discharge chamber 231 to a condenser (not shown), which is included in the refrigeration circuit. The suction port 330 connects the swash plate chamber 33 to an evaporator (not shown), which is included in the refrigeration circuit.

The third front communication passage 18*c* includes a front end that opens at a front end of the second cylinder block 23 and a rear end that is in communication with the converging discharge chamber 231. When the first cylinder block 21 is joined with the second cylinder block 23, the third front communication passage 18*c* is connected to the rear end of the second front communication passage 18*b*.

The second rear communication passage 20*b* includes a front end that is in communication with the converging discharge chamber 231 and a rear end that opens at the rear end of the second cylinder block 23.

The first valve formation plate 39 is arranged between the front housing member 17 and the first cylinder block 21. The second valve formation plate 41 is arranged between the rear housing member 19 and the second cylinder block 23.

The first valve formation plate 39 includes a first valve plate 390, a first suction valve plate 391, a first discharge valve plate 392, and a first retainer plate 393. First suction holes 390*a* extend through the first valve plate 390, the first discharge valve plate 392, and the first retainer plate 393. The number of the first suction holes 390*a* is the same as the number of the first cylinder bores 21*a*. First discharge holes 390*b* extend through the first valve plate 390 and the first suction valve plate 391. The number of the first discharge holes 390*b* is the same as the number of the first cylinder bores 21*a*. A first suction communication hole 390*c* extends through the first valve plate 390, the first suction valve plate 391, the first discharge valve plate 392, and the first retainer plate 393. A first discharge communication hole 390*d* extends through the first valve plate 390 and the first suction valve plate 391.

Each first cylinder bore 21*a* is in communication with the first suction chamber 27*a* through the corresponding first suction hole 390*a*. Further, each first cylinder bore 21*a* is in communication with the first discharge chamber 29*a* through the corresponding first discharge hole 390*b*. The first suction chamber 27*a* is in communication with the first communication passage 37*a* through the first suction communication hole 390*c*. The first front communication passage 18*a* is in communication with the second front communication passage 18*b* through the first discharge communication hole 390*d*.

The first suction valve plate 391 is arranged on the rear surface of the first valve plate 390. The first suction valve plate 391 includes first suction reed valves 391*a*, which may be elastically deformed to open and close the corresponding first suction holes 390*a*. The first discharge valve plate 392 is arranged on the front surface of the first valve plate 390. The first discharge valve plate 392 includes first discharge reed valves 392*a*, which may be elastically deformed to open and close the corresponding first discharge holes 390*b*. The first retainer plate 393 is arranged on the front surface of the first discharge valve plate 392. The first retainer plate 393 restricts the maximum open degree of each first discharge reed valve 392*a*.

The second valve formation plate 41 includes a second valve plate 410, a second suction valve plate 411, a second discharge valve plate 412, and a second retainer plate 413. Second suction holes 410*a* extend through the second valve plate 410, the second discharge valve plate 412, and the second retainer plate 413. The number of the second suction holes 410*a* is the same as the number of the second cylinder bores 23*a*. Second discharge holes 410*b* extend through the second valve plate 410 and the second suction valve plate 411. The number of the second discharge holes 410*b* is the same as the number of the second cylinder bores 23*a*. A second suction communication hole 410*c* extends through the second valve plate 410, the second suction valve plate 411, the second discharge valve plate 412, and the second retainer plate 413. A second discharge communication hole 410*d* extends through the second valve plate 410 and the second suction valve plate 411.

Each second cylinder bore 23*a* is in communication with the second suction chamber 27*b* through the corresponding second suction hole 410*a*. Further, each second cylinder bore 23*a* is in communication with the second discharge chamber 29*b* through the corresponding second discharge hole 410*b*. The second suction chamber 27*b* is in communication with the second communication passage 37*b* through the second suction communication hole 410*c*. The first rear communication passage 20*a* is in communication with the second rear communication passage 20*b* through the second discharge communication hole 410*d*.

The second suction valve plate 411 is arranged on the front surface of the second valve plate 410. The second suction valve plate 411 includes the second suction reed valves 411*a*, which may be elastically deformed to open and close the corresponding second suction holes 410*a*. The second discharge valve plate 412 is arranged on the rear surface of the second valve plate 410. The second discharge valve plate 412 includes second discharge reed valves 412*a*, which may be elastically deformed to open and close the corresponding second discharge holes 410*b*. The second retainer plate 413 is arranged on the rear surface of the second discharge valve plate 412. The second retainer plate 413 restricts the maximum open degree of each second discharge reed valve 412*a*.

In the compressor, the first front communication passage 18*a*, the first discharge communication hole 390*d*, the second front communication passage 18*b*, and the third front communication passage 18*c* form a first discharge communication passage 18. Further, the first rear communication passage 20*a*, the second discharge communication hole 410*d*, and the second rear communication passage 20*b* form a second discharge communication passage 20.

In the compressor, the first and second suction chambers 27*a* and 27*b* are in communication with the swash plate chamber 33 through the first and second communication passages 37*a* and 37*b* and the first and second suction communication holes 390*c* and 410*c*. Thus, the pressure of the first and second suction chambers 27*a* and 27*b* is substantially equal to the pressure of the swash plate chamber 33. Low-pressure refrigerant gas from the evaporator flows into the swash plate chamber 33 through the suction port 330. Thus, the pressure of the swash plate chamber 33 and the first and second suction chambers 27*a* and 27*b* is lower than the pressure of the first and second discharge chambers 29*a* and 29*b*.

The drive shaft 3 includes a shaft body 30, a first support member 43*a*, and a second support member 43*b*. The shaft body 30 includes a front portion defining a first small diameter portion 30*a* and a rear portion defining a second small diameter portion 30*b*. The shaft body 30, which extends from the front to the rear of the housing 1, extends through the sealing device 25 and the first and second plain bearings 22*a* and 22*b*. Thus, the shaft body 30 and, consequently, the drive shaft 3 are supported by the housing 1 rotationally about the axis O of the drive shaft 3. The shaft body 30 has a front end located in the boss 17*a* and a rear end projecting into the pressure regulation chamber 31.

The swash plate 5, the link mechanism 7, and an actuator 13 are arranged on the shaft body 30. The swash plate 5, the link mechanism 7, and the actuator 13 are each located in the swash plate chamber 33.

The first support member 43*a* is fitted to the first small diameter portion 30*a* of the shaft body 30. Further, the first support member 43*a* is located between the first small diameter portion 30*a* and the first plain bearing 22*a* in the first shaft bore 21*b*. The first support member 43*a* includes a flange 430, which contacts the first thrust bearing 35*a*, and a coupling portion (not shown), through which a second pin 47*b* is inserted. The front end of a recovery spring 44*a* is fitted to the first support member 43*a*. The recovery spring 44*a* extends from the flange 430 toward the swash plate 5 along the axis O of the drive shaft 3.

The second support member 43*b* is fitted to the rear of the second small diameter portion 30*b* of the shaft body 30 and located in the second shaft bore 23*b*. The front portion of the second support member 43*b* includes a flange 431, which contacts the second thrust bearing 35*b*. O-rings 51*a* and 51*b* are arranged on the second support member 43*b* at the rear side of the flange 431.

Referring to FIG. 1, the swash plate 5 is an annular plate and includes a front surface 5*a* and a rear surface 5*b*. The front surface 5*a* faces the front side of the compressor in the swash plate chamber 33. The rear surface 5*b* faces the rear side of the compressor in the swash plate chamber 33.

The swash plate 5 includes a ring plate 45. The ring plate 45 is an annular plate. An insertion hole 45*a* extends through the center of the ring plate 45. The shaft body 30 is inserted through the insertion hole 45*a* in the swash plate chamber 33 to couple the swash plate 5 to the drive shaft 3.

Figure 3A:
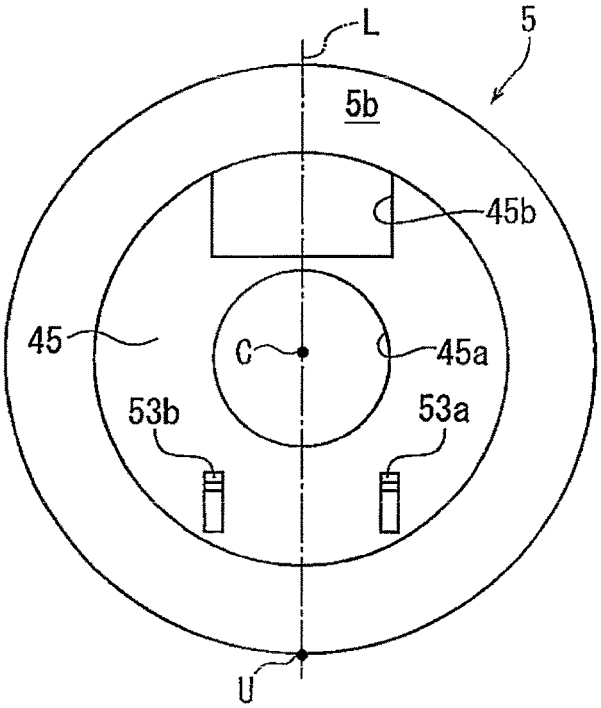
FIG. 3A is a front view of a swash plate in the compressor of FIG. 1.

Referring to FIG. 3A, the surface of the ring plate 45 located at the same side as the rear surface 5*b* of the swash plate 5 includes two abutment portions 53*a* and 53*b*. The abutment portions 53*a* and 53*b* are separated from the center C of the swash plate 5 toward the lower end U of the swash plate 5. Further, the abutment portions 53*a* and 53*b* are arranged symmetrically relative to the center line L that extends through the center C of the swash plate 5.

Figure 3B:
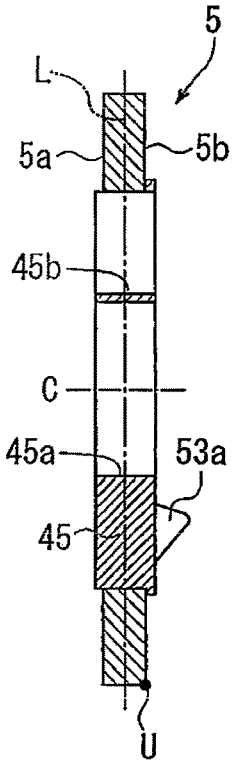
FIG. 3B is a cross-sectional view of the swash plate in the compressor of FIG. 1.

The abutment portions 53*a* and 53*b* are identically shaped, triangular in cross-section, and project toward the rear from the ring plate 45 as shown in FIG. 3B. Referring to FIG. 1, when the swash plate 5 is inclined at a first predetermined inclination angle, the abutment portions 53*a* and 53*b* contact a partitioning body 13*b*, which will be described later. The abutment portions 53*a* and 53*b* may be designed to have any suitable shape.

The ring plate 45 includes a coupler (not shown) coupled to pulling arms 132, which will be described later.

As shown in FIG. 1, the link mechanism 7 includes a lug arm 49. The lug arm 49 is arranged at the front side of the swash plate 5 in the swash plate chamber 33 and located between the swash plate 5 and the first support member 43*a*. The lug arm 49 is generally L-shaped. The rear end of the lug arm 49 includes a weight 49*a*. The weight 49*a* extends over one half of the circumference of the actuator 13. The weight 49*a* may be designed to have a suitable shape.

A first pin 47*a* couples the rear end of the lug arm 49 to an upper portion of the ring plate 45. The first pin 47*a* corresponds to a supporting portion of the present invention. Thus, the lug arm 49 is supported by the ring plate 45, or the swash plate 5, so that the lug arm 49 is pivotal about the axis of the first pin 47*a*, namely, a first pivot axis M1. The first pivot axis M1 extends in a direction perpendicular to the axis O of the drive shaft 3. The drive shaft 3 is located between abutment portions 53*a* and 53*b* and the first pin 47*a*, or the first pivot axis M1.

A second pin 47*b* couples the front end of the lug arm 49 to the first support member 43*a*. Thus, the lug arm 49 is supported by the support member 43*a*, or the drive shaft 3, so that the lug arm 49 is pivotal about the axis of the second pin 47*b*, namely, a second pivot axis M2. The second pivot axis M2 extends parallel to the first pivot axis M1. The lug arm 49 and the first and second pins 47*a* and 47*b* are elements forming the link mechanism 7 of the present invention.

The weight 49*a* extends toward the rear of the lug arm 49, that is, the side opposite to the second pivot axis M2 as viewed from the first pivot axis M1. The lug arm 49 is supported by the first pin 47*a* on the ring plate 45 so that the weight 49*a* is inserted through a groove 45*b* in the ring plate 45 and is located at the rear side of the ring plate 45, that is, the same side as the rear surface 5*b* of the swash plate 5. Rotation of the swash plate 5 around the axis O of the drive shaft 3 generates centrifugal force that acts on the weight 49*a* at the rear side of the swash plate 5.

In the compressor, the link mechanism 7 couples the swash plate 5 and the drive shaft 3 so that the swash plate 5 is able to rotate together with the drive shaft 3. Further, the pivoting of two ends of the lug arm 49 about the first pivot axis M1 and the second pivot axis M2 enables the inclination angle of the swash plate 5 to be changed from the maximum inclination angle to the minimum inclination angle shown in FIG. 4.

Referring to FIG. 1, each piston 9 includes a front end that defines a first piston head 9*a* and a rear end that defines a second piston head 9*b*. The first piston head 9*a* is reciprocally accommodated in the corresponding first cylinder bore 21*a*. The first piston head 9*a* defines a first compression chamber 21*d* with the first valve formation plate 39 in the first cylinder bore 21*a*. The second piston head 9*b* is reciprocally accommodated in the corresponding second cylinder bore 23*a*. The second piston head 9*b* defines a second compression chamber 23*d* with the second valve formation plate 41 in the second cylinder bore 23*a*.

The middle of each piston 9 includes an engagement portion 9*c*, which accommodates the semispherical shoes 11*a* and 11*b*. The shoes 11*a* and 11*b* convert the rotation of the swash plate 5 to the reciprocation of the piston 9. The shoes 11*a* and 11*b* correspond to a conversion mechanism of the present invention. In this manner, the first and second piston heads 9*a* and 9*b* are reciprocated in the first and second cylinder bores 21*a* and 23*a* with a stroke that is in accordance with the inclination angle of the swash plate 5.

In the compressor, a change in the inclination angle of the swash plate 5 changes the stroke of the pistons 9. This, in turn, moves the top dead center of each of the first and second piston heads 9*a* and 9*b*. More specifically, a decrease in the inclination angle of the swash plate 5 moves the top dead center of the second piston head 9*b* more than the top dead center of the first piston head 9*a*.

Figure 5:
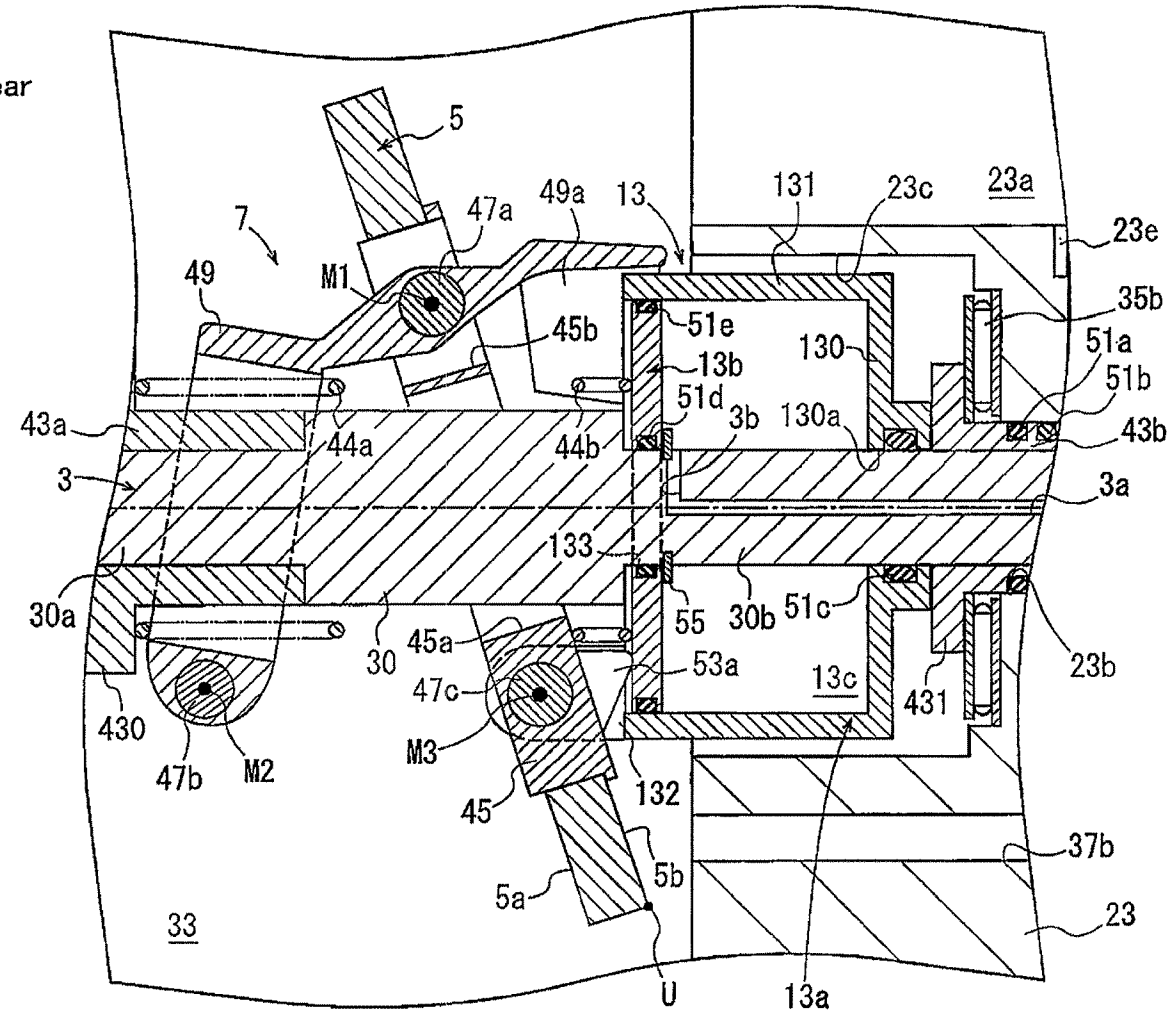
FIG. 5 is a partially enlarged cross-sectional view showing an abutment portion pushing a partitioning body in the compressor of FIG. 1.

Referring to FIG. 5, the actuator 13 is arranged in the swash plate chamber 33. The actuator 13 is located at the rear of the swash plate 5 in the swash plate chamber 33 and is movable into the second recess 23*c*. The actuator 13 includes a movable body 13*a*, the partitioning body 13*b*, and the control pressure chamber 13*c*. The control pressure chamber 13*c* is defined between the movable body 13*a* and the partitioning body 13*b*.

The movable body 13*a* includes a rear wall 130, a circumferential wall 131, and two pulling arms 132. Each pulling arm 132 corresponds to a coupling portion of the present invention. The rear wall 130 is located at the rear of the movable body 13*a* and extends in the radial direction toward the outer side from the axis O of the drive shaft 3. An insertion hole 130*a* extends through the rear wall 130. The second small diameter portion 30*b* of the shaft body 30 is inserted through the insertion hole 130*a*. An O-ring Sic is arranged in the wall of the insertion hole 130*a*. The circumferential wall 131 is continuous with the outer circumference of the rear wall 130 and extends toward the front of the movable body 13*a*. Each pulling arm 132 is formed on the front end of the circumferential wall 131 and projects toward the front of the movable body 13*a*. The rear wall 130, the circumferential wall 131, and the pulling arms 132 are arranged so that the movable body 13*a* has the form of a cylinder that has a closed end.

The partitioning body 13*b* is disk-shaped and has a diameter that is substantially the same as the inner diameter of the movable body 13*a*. An insertion hole 133 extends through the center of the partitioning body 13*b*. An O-ring 51*d* is arranged in the wall of the insertion hole 133. Further, an O-ring 51*e* is arranged on the outer circumferential surface of the partitioning body 13*b*.

An inclination angle reduction spring 44*b* is located between the partitioning body 13*b* and the ring plate 45. More specifically, the rear end of the inclination angle reduction spring 44*b* contacts the partitioning body 13*b*, and the front end of the inclination angle reduction spring 44*b* contacts the ring plate 45.

The second small diameter portion 30*b* of the drive shaft 3 is inserted through the insertion hole 130*a* of the movable body 13*a* and the insertion hole 133 of the partitioning body 13*b*. Thus, when the movable body 13*a* is accommodated in the second recess 23*c*, the movable body 13*a* and the link mechanism 7 are located at opposite sides of the swash plate 5.

The partitioning body 13*b* is located in the movable body 13*a* at the rear of the swash plate 5 and surrounded by the circumferential wall 131. The partitioning body 13*b* is rotatable together with the drive shaft 3 and movable along the axis O of the drive shaft 3 in the swash plate chamber 33. In this manner, when the movable body 13*a* and the partitioning body 13*b* move along the axis O of the drive shaft 3, the inner circumferential surface of the circumferential wall 131 of the movable body 13*a* moves along the outer circumferential surface of the partitioning body 13*b*.

By surrounding the partitioning body 13*b* with the circumferential wall 131, the control pressure chamber 13*c* is formed between the movable body 13*a* and the partitioning body 13*b*. The control pressure chamber 13*c* is partitioned from the swash plate chamber 33 by the rear wall 130, the circumferential wall 131, and the partitioning body 13*b*.

A snap ring 55 is fitted to the second small diameter portion 30*b*. The snap ring 55 is located in the control pressure chamber 13*c* on the second small diameter portion 30*b* near a radial passage 3*b*, which will be described later. The snap ring 55 corresponds to a movement amount restriction portion of the present invention. Instead of the snap ring 55, for example, a flange may be arranged on the second small diameter portion 30*b* to serve as the movement amount restriction portion of the present invention.

A third pin 47*c* couples the pulling arms 132 to the lower end, which is indicated by "U" in the drawings, of the ring plate 45. The third pin 47*c* corresponds to the coupling portion of the present invention. Thus, the swash plate 5 is supported by the movable body 13*a* so as to be pivotal about the axis of the third pin 47*c*, namely, an action axis M3. The action axis M3 extends parallel to the first and second pivot axes M1 and M2. In this manner, the movable body 13*a* is coupled to the swash plate 5 so that the partitioning body 13*b* is opposed to the swash plate 5. In the compressor, the pulling arms 132 and the third pin 47*c*, which form the coupling portion, are opposed to the first pin 47*a*, which serves as the supporting portion, with the abutment portions 53*a* and 53*b* disposed in between. More specifically, the coupling portion (pulling arms 132 and third pin 47*c*) is located at the opposite side of the supporting portion (first pin 47*a*) as viewed from the center C of the swash plate 5. The abutment portions 53*a* and 53*b* are located between the coupling portion (pulling arms 132 and third pin 47*c*) and the supporting portion (first pin 47*a*) near the coupling portion (pulling arms 132 and third pin 47*c*). In other words, the abutment portions 53*a* and 53*b* are located closer to the coupling portion than the center C of the swash plate 5.

As shown in FIG. 1, an axial passage 3*a* extends through the second small diameter portion 30*b* from the rear end toward the front along the axis O of the drive shaft 3. The radial passage 3*b* extends through the second small diameter portion 30*b* from the front end of the axial passage 3*a* in the radial direction and opens in the outer surface of the shaft body 30. The rear end of the axial passage 3*a* is in communication with the pressure regulation chamber 31. The radial passage 3*b* is in communication with the control pressure chamber 13*c*. Thus, the control pressure chamber 13*c* is in communication with the pressure regulation chamber 31 through the radial passage 3*b* and the axial passage 3*a*.

The front end of the shaft body 30 includes a threaded portion 3*c*. The threaded portion 3*c* couples the drive shaft 3 to a pulley or an electromagnetic clutch (neither shown).

As shown in FIG. 2, the control mechanism 15 includes a bleed passage 15*a*, a gas supplying passage 15*b*, a control valve 15*c*, an orifice 15*d*, the axial passage 3*a*, and the radial passage 3*b*.

The bleed passage 15*a* is connected to the pressure regulation chamber 31 and the second suction chamber 27*b*. The control pressure chamber 13*c*, the pressure regulation chamber 31, and the second suction chamber 27*b* are in communication with one another through the bleed passage 15*a*, the axial passage 3*a*, and the radial passage 3*b*. The gas supplying passage 15*b* is connected to the pressure regulation chamber 31 and the second discharge chamber 29*b*. The control pressure chamber 13*c*, the pressure regulation chamber 31, and the second discharge chamber 29*b* are in communication with one another through the gas supplying passage 15*b*, the axial passage 3*a*, and the radial passage 3*b*. The gas supplying passage 15*b* includes the orifice 15*d*.

The control valve 15*c* is arranged in the bleed passage 15*a*. The control valve 15*c* is able to adjust the open degree of the bleed passage 15*a* based on the pressure of the second suction chamber 27*b*.

In the compressor, a pipe leading to the evaporator is connected to the suction port 330. A pipe leading to a condenser is connected to the discharge port 230. The condenser is connected to the evaporator by a pipe and an expansion valve. The compressor, the evaporator, an expansion valve, the condenser, and the like form the refrigeration circuit of the vehicle air conditioner. The evaporator, the expansion valve, the condenser, and the pipes are not shown in the drawings.

In the compressor, the rotation of the drive shaft 3 rotates the swash plate 5 and reciprocates each piston 9 in the corresponding first and second cylinder bores 21*a* and 23*a*. Thus, the volumes of the first and second compression chambers 21*d* and 23*d* change in accordance with the piston stroke. This repeats a suction phase that draws refrigerant gas into the first and second compression chambers 21*d* and 23*d*, a compression phase that compresses the refrigerant gas in the first and second compression chambers 21*d* and 23*d*, and a discharge phase that discharges the compressed refrigerant gas to the first and second discharge chambers 29*a* and 29*b*.

The refrigerant gas discharged to the first discharge chamber 29*a* flows through the first discharge communication passage 18 to the converging discharge chamber 231. In the same manner, the refrigerant gas discharged to the second discharge chamber 29*b* flows through the second discharge communication passage 20 to the converging discharge chamber 231. The refrigerant gas is discharged from the converging discharge chamber 231 through the discharge port 230 and delivered through a pipe to the condenser.

During the phases such as the suction phase, a compression reaction that acts to decrease the inclination angle of the swash plate 5 acts on rotational members including the swash plate 5, the ring plate 45, the lug arm 49, and the first pin 47*a*. A change in the inclination angle of the swash plate would increase or decrease the stroke of the pistons 9 that control the compressor displacement.

More specifically, when the control valve 15*c* in the control mechanism 15 shown in FIG. 2 increases the open degree of the bleed passage 15*a*, the pressure of the pressure regulation chamber 31 and, consequently, the pressure of the control pressure chamber 13*c* become substantially equal to the pressure of the second suction chamber 27*b*. Namely, the variable pressure difference between the control pressure chamber 13*c* and the swash plate chamber 33 is decreased. Thus, referring to FIG. 4, the piston compression force acting on the swash plate 5 moves the movable body 13*a* of the actuator 13 toward the front in the swash plate chamber 33.

Figure 4:
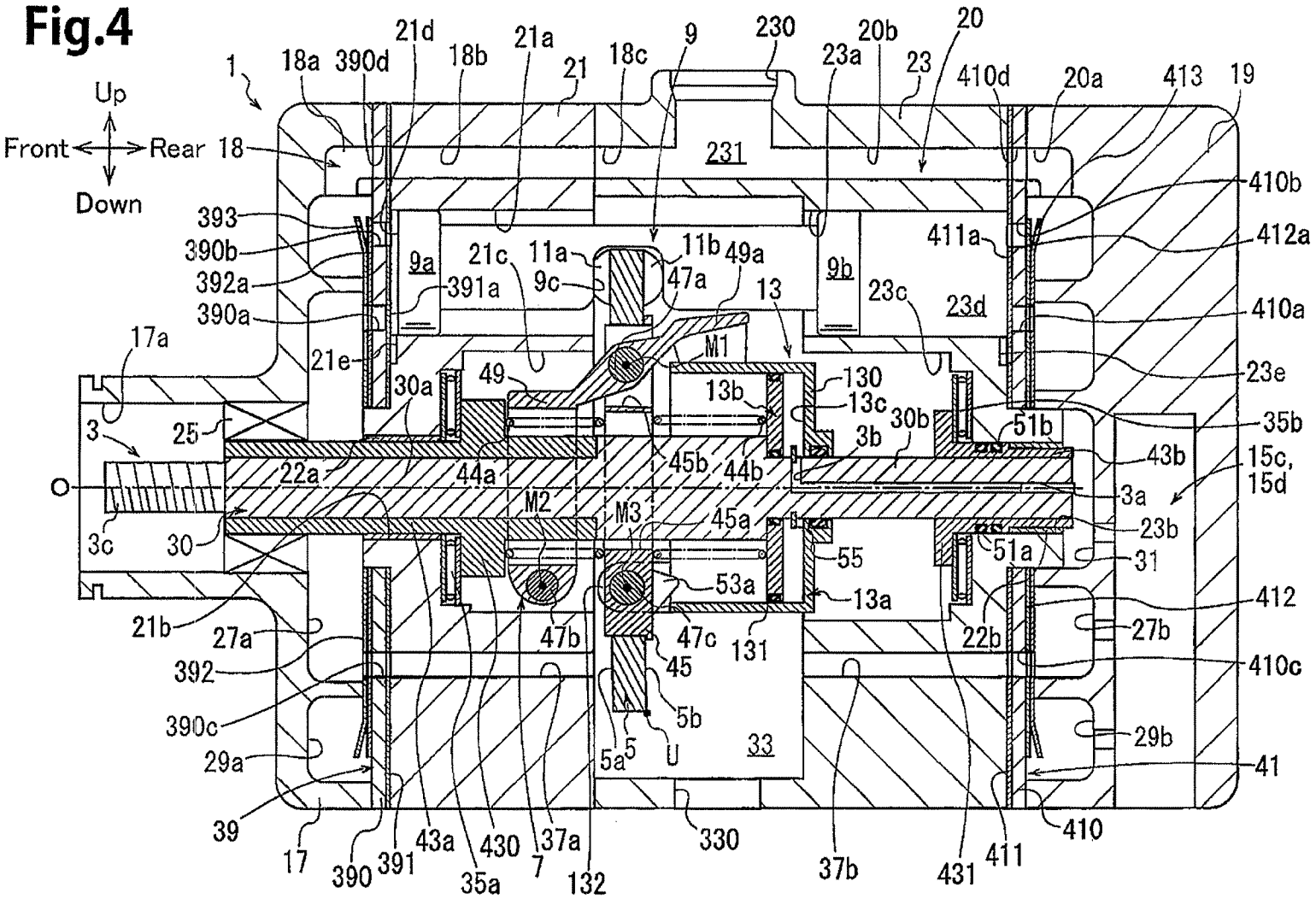
FIG. 4 is a cross-sectional view showing the compressor of FIG. 1 when the displacement is minimal.

As a result, in the compressor, compression reaction, which acts on the swash plate 5 through the pistons 9, urges the swash plate 5 in the direction that decreases the inclination angle. This pulls the movable body 13*a* toward the front of the swash plate chamber 33 with the pulling arms 132 at the action axis M3. Thus, in the compressor, the lower end U of the swash plate 5 is pivoted in the clockwise direction about the action axis M3 against the urging force of the recovery spring 44*a*. Further, the rear end of the lug arm 49 pivots in the counterclockwise direction about the first pivot axis M1, and the front end of the lug arm 49 pivots in the counterclockwise direction about the second pivot axis M2. Thus, the lug arm 49 moves toward the flange 430 of the first support member 43*a*. Consequently, the swash plate 5 is pivoted using the action axis M3 as an action point and the first pivot axis M1 as a fulcrum point. In this manner, the inclination angle of the swash plate 5 relative to a plane orthogonal to the rotation axis O of the drive shaft 3 decreases and shortens the stroke of the pistons 9 thereby decreasing the compressor displacement for each rotation of the drive shaft 3. The inclination angle of the swash plate 5 in FIG. 4 is the minimum inclination angle of the compressor.

In the compressor, the centrifugal force acting on the weight 49*a* is applied to the swash plate 5. Thus, in the compressor, the swash plate 5 may easily be moved in the direction that decreases the inclination angle.

When the inclination angle of the swash plate 5 decreases, the ring plate 45 comes into contact with the rear end of the recovery spring 44*a*. This elastically deforms the recovery spring 44*a* and moves the rear end of the recovery spring 44*a* toward the flange 430.

In the compressor, when the inclination angle of the swash plate 5 decreases and shortens the stroke of the pistons 9, the top dead center of each second piston head 9*b* is moved away from the second valve formation plate 41. Thus, in the compressor, the inclination angle of the swash plate 5 becomes close to zero degrees. As a result, the first compression chambers 21*d* slightly compress refrigerant gas, while the second compression chambers 23*d* do not perform compression at all.

When the control valve 15*c* shown in FIG. 2 decreases the open degree of the bleed passage 15*a*, the pressure of the refrigerant gas in the second discharge chamber 29*b* raises the pressure of the pressure regulation chamber 31 thereby raising the pressure of the control pressure chamber 13*c*. As a result, the variable pressure difference is increased. Thus, referring to FIG. 1, in the actuator 13, the movable body 13*a* moves toward the rear of the swash plate chamber 33 against the piston compression force acting on the swash plate 5.

As a result, in the compressor, the movable body 13*a* pulls rearward the section of the swash plate 5 near the lower end U with the pulling arms 132 at the action axis M3. Thus, in the compressor, the lower end U of the swash plate 5 is pivoted in the counterclockwise direction about the action axis M3. Further, the rear end of the lug arm 49 pivots in the clockwise direction about the first pivot axis M1, and the front end of the lug arm 49 pivots in the clockwise direction about the second pivot axis M2. Thus, the lug arm 49 moves away from the flange 430 of the first support member 43*a*. Consequently, using the action axis M3 as an action point and the first pivot axis M1 as a fulcrum point, the swash plate 5 is pivoted in a direction opposite to the direction that decreases the inclination angle, and the section at the lower end U of the swash plate 5 moves toward the partitioning body 13*b*. In this manner, the inclination angle of the swash plate 5 increases and lengthens the stroke of the pistons 9 thereby increasing the compressor displacement for each rotation of the drive shaft 3. The inclination angle of the swash plate 5 in FIG. 1 is the first predetermined inclination angle of the compressor. The first predetermined inclination angle is set in the compressor and smaller than the maximum inclination angle, which is mechanically set.

In this manner, when the swash plate 5 of the compressor is inclined at the first predetermined inclination angle, the abutment portions 53*a* and 53*b* contact the partitioning body 13*b*. This restricts the inclination angle to the first predetermined angle in the compressor.

The abutment portions 53*a* and 53*b* are separated from the center C toward the lower end U of the swash plate 5. Thus, the abutment portions 53*a* and 53*b* contact a peripheral portion of the partitioning body 13*b*, that is, a location separated from the insertion hole 133.

Referring to FIG. 5, when suddenly increasing the compressor displacement to the maximum, the swash plate 5 may overshoot the first predetermined inclination angle and reach the maximum inclination angle. In this case, the abutment portions 53*a* and 53*b* would come to contact and push the partitioning body 13*b* with a strong force.

In the compressor, however, the partitioning body 13*b* is movable along the axis O of the drive shaft 3. Accordingly, even if the abutment portions 53*a* contact or push the partitioning body 13*b* with a strong force, the partitioning body 13*b* is moved toward the rear along the axis O of the drive shaft 3 in a direction opposite to the abutment portions 53*a* and 53*b*. That is, when the inclination angle of the swash plate 5 goes beyond the first predetermined inclination angle and reaches the maximum inclination angle, the abutment portions 53*a* and 53*b* move the partitioning body 13*b*. When moved toward the rear, the partitioning body 13*b* comes into contact with the snap ring 55. This restricts further rearward movement of the partitioning body 13*b*.

In this manner, the compressor suppresses the shock and the pressing force of the abutment portions 53*a* and 53*b* when coming to contact or pushing the partitioning body 13*b*. Thus, the compressor reduces vibration when the abutment portions 53*a* and 53*b* come to contact the partitioning body 13*b* and limits damage to the swash plate 5, the partitioning body 13*b*, and the abutment portions 53*a* and 53*b*. Further, the compressor reduces noise.

Accordingly, the compressor of the first embodiment has high durability and superior quietness.

In the compressor, the partitioning body 13*b* is moved along the axis O of the drive shaft 3. Thus, even though the swash plate 5 and the partitioning body 13*b* are located near each other, open space for the abutment portions 53*a* and 53*b* may be obtained between the swash plate 5 and the partitioning body 13*b*. This allows the compressor to be reduced in length in the axial direction.

Further, the compressor includes the snap ring 55 on the small diameter portion 30*b* of the shaft body 30. Thus, contact of the partitioning body 13*b* with the snap ring 55 restricts the movement amount of the partitioning body 13*b* along the axis O of the drive shaft 3. This limits unnecessary rearward movement of the partitioning body 13*b* along the axis O of the drive shaft 3 and keeps the radial passage 3*b* unexposed to the outside of the control pressure chamber 13*c*, that is, unexposed to the swash plate chamber 33.

The snap ring 55 is located in the control pressure chamber 13*c* near the radial passage 3*b*. Thus, there is no need to obtain open space dedicated for the snap ring 55 in the control pressure chamber 13*c*, and the control pressure chamber 13*c* may be reduced in size. This also allows the compressor to be reduced in length in the axial direction.

In the compressor, the partitioning body 13*b* is movable along the axis O of the drive shaft 3. This allows the movable body 13*a* to easily move relative to the partitioning body 13*b* when changing the inclination angle of the swash plate 5. Thus, the compressor is able to smoothly change the inclination angle of the swash plate 5.

Second Embodiment

Figure 6:
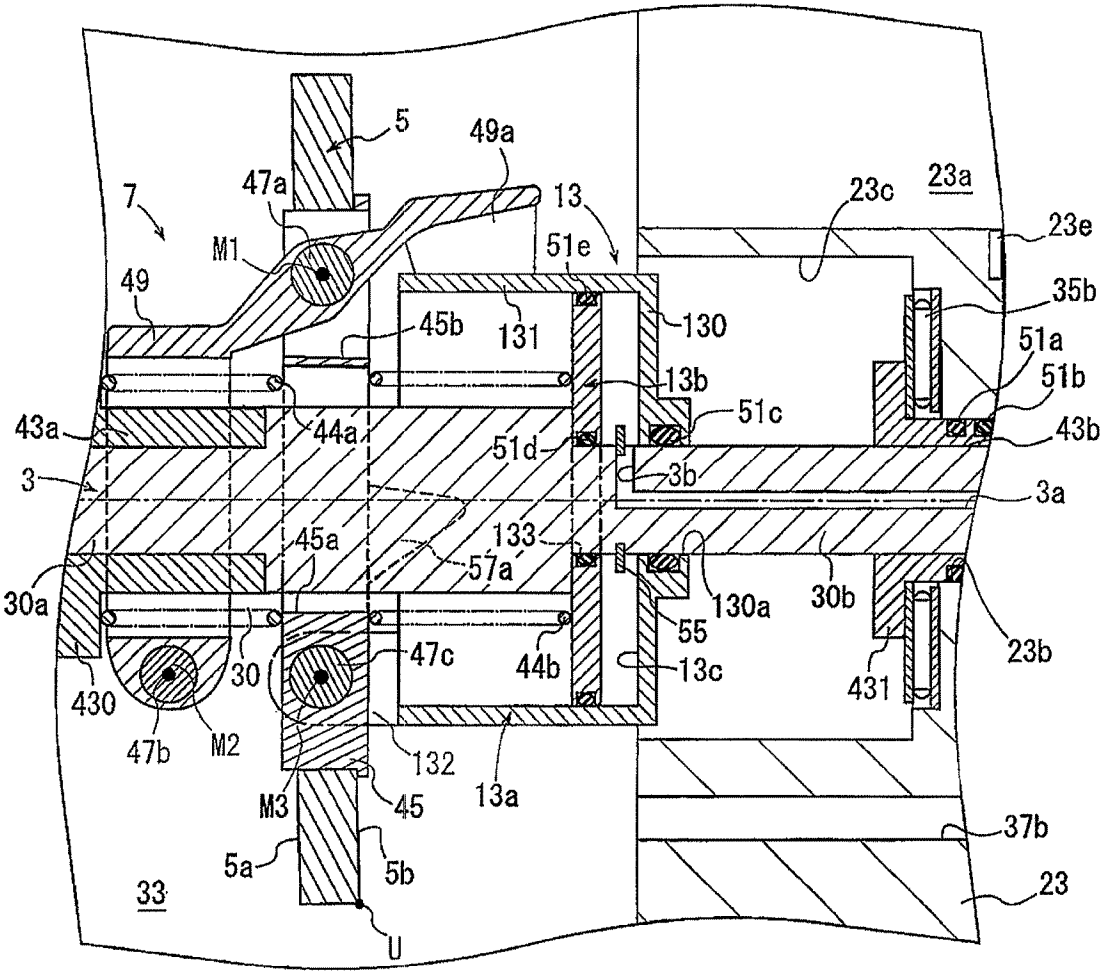
FIG. 6 is a partially enlarged cross-sectional view showing a compressor of a second embodiment when the inclination angle of the swash plate is minimal.
Figure 7A:
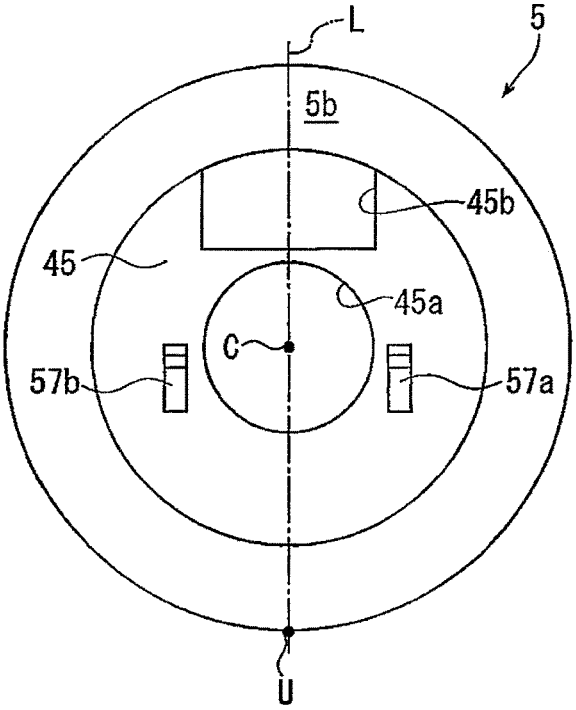
FIG. 7A is a front view of the swash plate in the compressor of FIG. 6.

A compressor of a second embodiment includes two abutment portions 57*a* and 57*b* shown in FIG. 6 instead of the two abutment portions 53*a* and 53*b* of the compressor in the first embodiment. Referring to FIG. 7A, the abutment portions 57*a* and 57*b* are formed on the surface of the ring plate 45 located at the same side as the rear surface 5*b* of the swash plate 5. The abutment portions 57*a* and 57*b* are located proximate to the center C of the swash plate 5, that is, closer to the center C than the lower end U of the swash plate 5. In the same manner as the abutment portions 53*a* and 53*b* in the compressor of the first embodiment, the abutment portions 57*a* and 57*b* are symmetric relative to the center line L that extends through the center C. In the compressor, the pulling arms 132 and the third pin 47*c*, which form the coupling portion, and the first pin 47*a*, which serves as the supporting portion, are located at opposite sides of the abutment portions 57*a* and 57*b*.

Figure 7B:
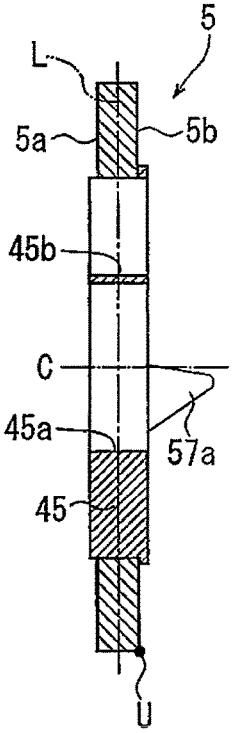
FIG. 7B is a cross-sectional view of the swash plate in the compressor of FIG. 6.

The abutment portions 57*a* and 57*b* are identically shaped, triangular, and project toward the rear from the ring plate 45 as shown in FIG. 7B. The abutment portions 57*a* and 57*b* are larger than the abutment portions 53*a* and 53*b* in the compressor of the first embodiment.

Figure 8:
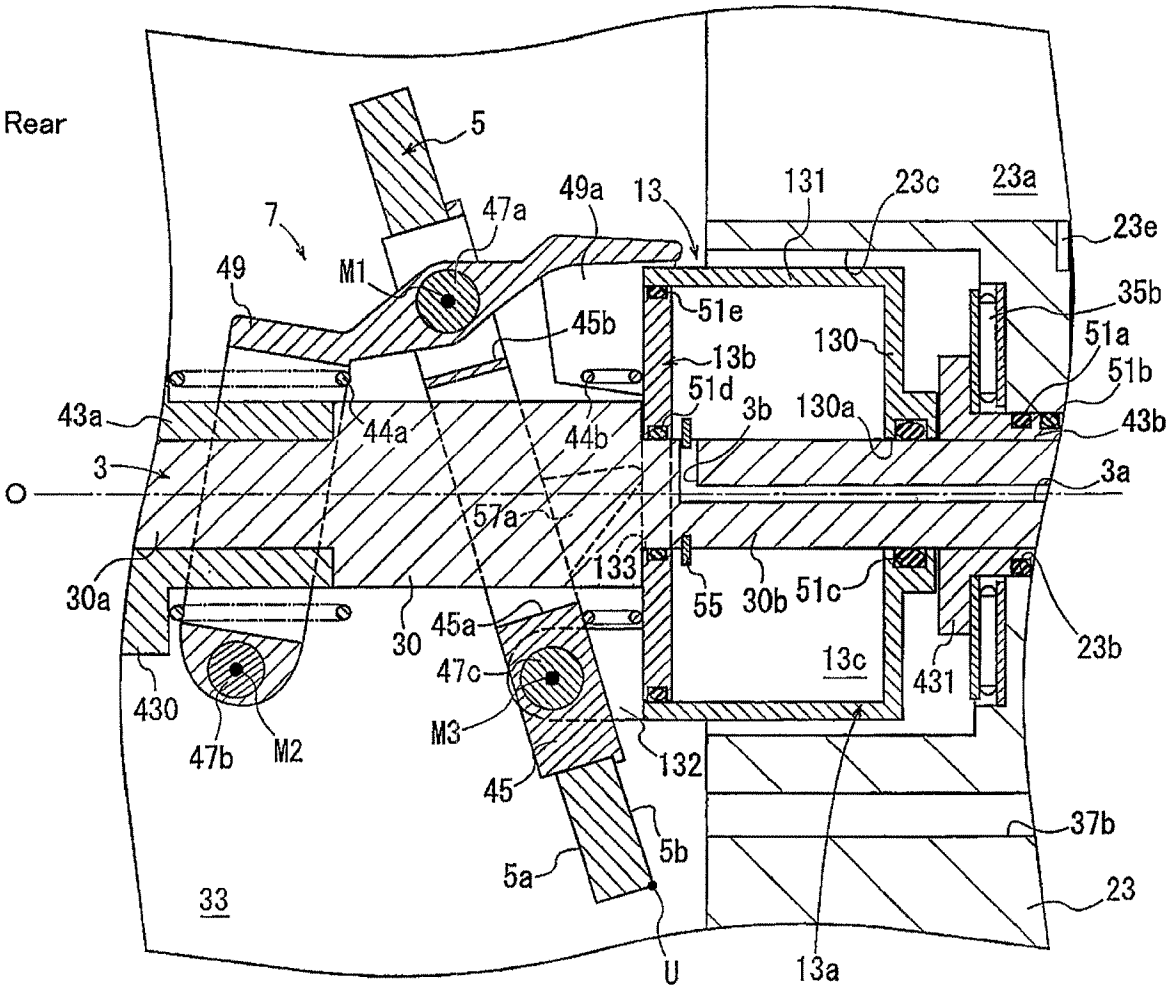
FIG. 8 is a partially enlarged cross-sectional view showing the swash plate at a predetermined second inclination angle in the compressor of FIG. 6.

Referring to FIG. 8, when the swash plate 5 is inclined at a second predetermined inclination angle, the abutment portions 57*a* and 57*b* contact the partitioning body 13*b*. The second predetermined inclination angle is greater than the minimum inclination angle of the swash plate 5 (refer to FIG. 6) and less than the mechanically set maximum inclination angle of the swash plate 5 (refer to FIG. 9). Other components of the compressor are the same as those in the compressor of the first embodiment. Same reference numerals are given to those components that are the same as the corresponding components of the first embodiment. Such components will not be described in detail.

Figure 9:
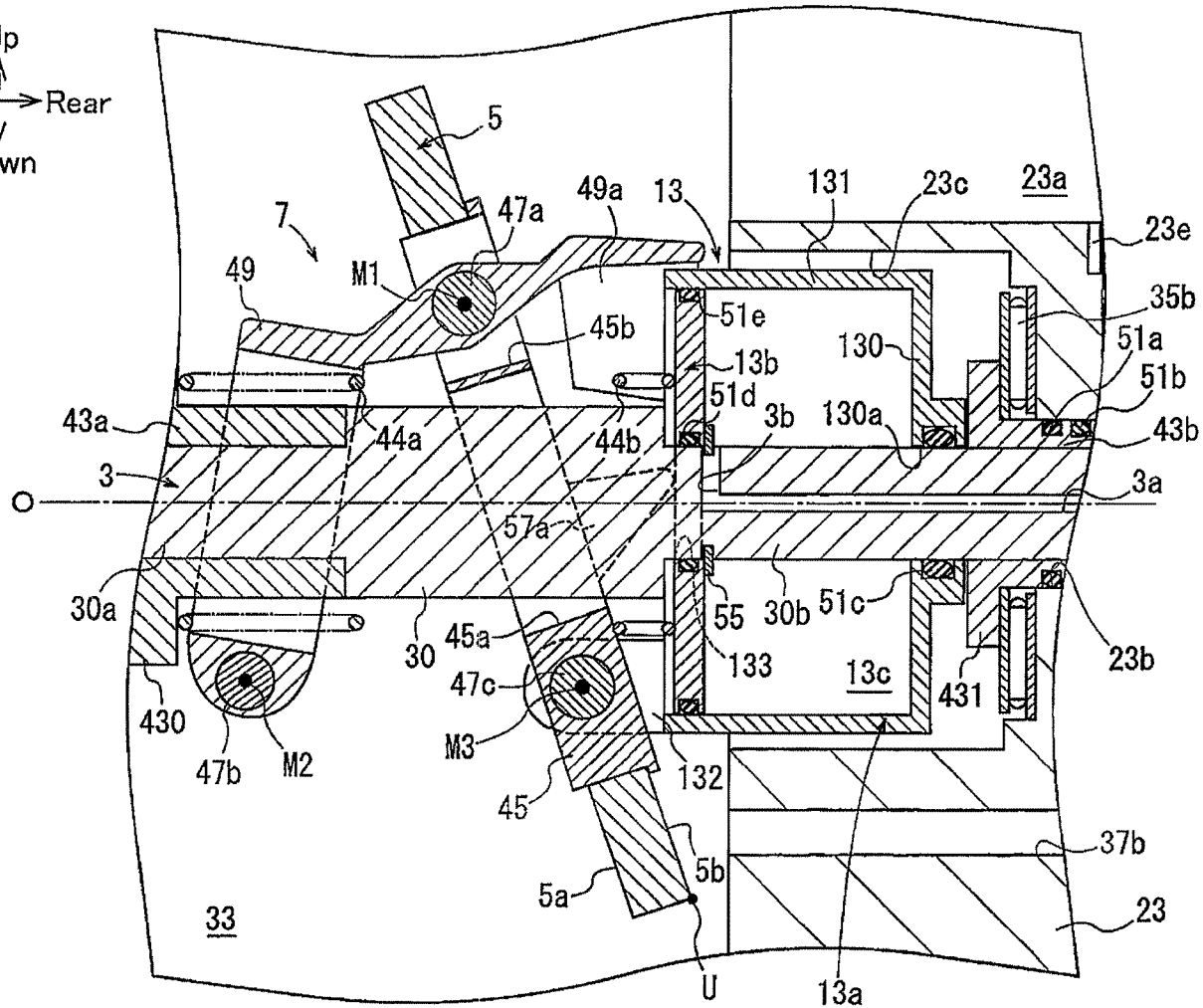
FIG. 9 is a partially enlarged cross-sectional view showing the compressor of FIG. 6 when the inclination angle of the swash plate is maximal.

In the compressor, as shown in FIG. 8, when the swash plate 5 is inclined at the second predetermined inclination angle, the abutment portions 57*a* and 57*b* contact the partitioning body 13*b*. Referring to FIG. 9, when the inclination angle of the swash plate 5 changes from the second predetermined inclination angle to the maximum inclination angle, the abutment portions 57*a* and 57*b*, which are in contact with the partitioning body 13*b*, push the partitioning body 13*b*. Thus, as the inclination angle of the swash plate 5 changes from the second predetermined inclination angle to the maximum inclination angle, the abutment portions 57*a* and 57*b* contact and push the partitioning body 13*b*, and the movable body 13*a* moves toward the rear along the axis O of the drive shaft 3. In this manner, when the inclination angle of the swash plate 5 increases from the second predetermined inclination angle to the maximum inclination angle, the abutment portions 57*a* and 57*b* push and move the partitioning body 13*b*.

Figure 10:
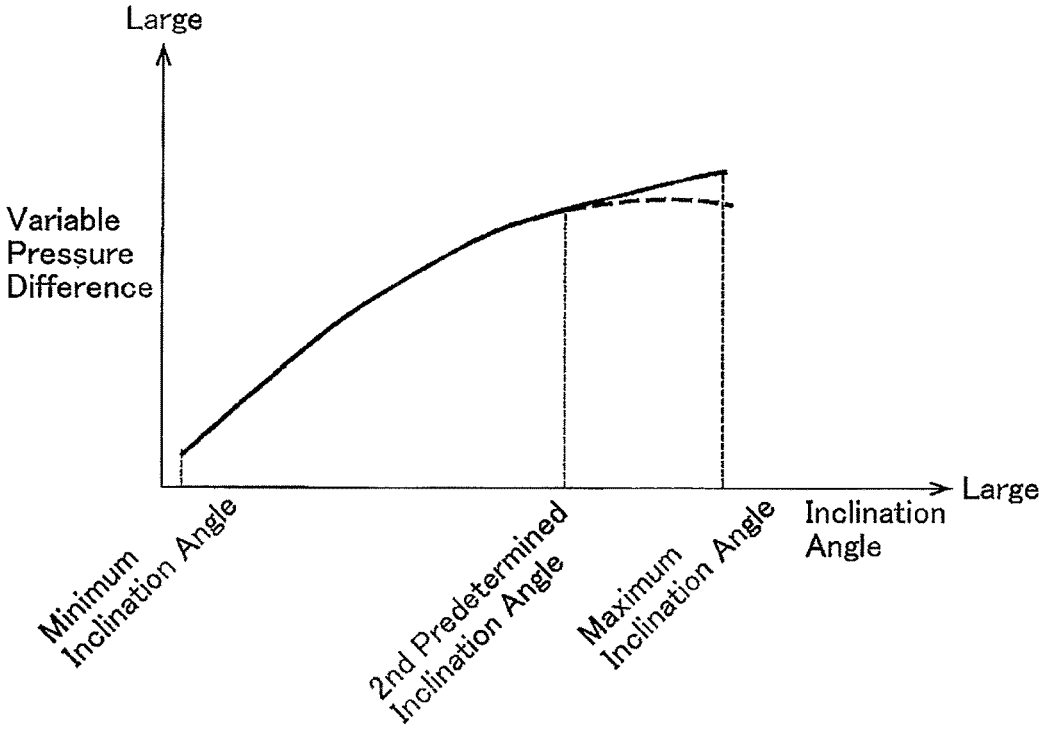
FIG. 10 is a graph showing the relationship of the swash plate inclination angle and the variable pressure difference.

In the compressor, as described above, the inclination angle of the swash plate 5 is increased by increasing the pressure of the control pressure chamber 13*c*, that is, increasing the variable pressure difference between the control pressure chamber 13*c* and the swash plate chamber 33. As shown in the graph of FIG. 10, the increasing rate of the variable pressure difference from the second predetermined inclination angle to the maximum inclination angle is larger than the increasing rate of the variable pressure difference when the inclination angle comes closer to the second predetermined inclination angle from the minimum inclination angle. That is, the variable pressure difference needs to be further increased to increase the inclination angle from the second predetermined inclination angle to the maximum inclination angle. In this manner, the pressure of the control pressure chamber 13*c* needs to be further increased in order to further increase the variable pressure difference and thereby increase the inclination angle from the second predetermined inclination angle to the maximum inclination angle.

If the abutment portions 57*a* and 57*b* were omitted from the compressor of the present embodiment and, at the same time, the partitioning body 13*b* arranged on the second small diameter portion 30*b* were immovable along the axis O, this would lower the increasing rate of the variable pressure difference for changing the inclination angle of the swash plate 5 from the second predetermined inclination angle to the maximum inclination angle, as shown in a flat dashed line in FIG. 10. This means that the inclination angle may be changed in a certain range even if the variable pressure difference is substantially the same. Thus, it would be difficult to control the swash plate 5 and obtain the desired inclination angle between the compressor displacement corresponding to the second predetermined inclination angle and the compressor displacement corresponding to the maximum inclination angle.

In this respect, the abutment portions 57*a* and 57*b* in the compressor of the present embodiment continue to contact and push the partitioning body 13*b* from when the inclination angle of the swash plate 5 reaches the second predetermined inclination angle to when the swash plate 5 reaches the maximum inclination angle. Thus, as shown in the solid line in FIG. 10, the compressor of the present embodiment allows the variable pressure difference to be increased in a preferred manner for changing the inclination angle from the second predetermined inclination angle to the maximum inclination angle. That is, in the compressor, the variable pressure difference smoothly increases from the minimum inclination angle to the maximum inclination angle. This allows the compressor to easily control the torque of the vehicle engine or the like while varying the compressor displacement in a preferred manner. Other operations of the compressor are the same as the compressor of the first embodiment.

The present invention is not restricted to the first and second embodiments described above. It should be apparent to those skilled in the art that the present invention may be embodied in many other specific forms without departing from the spirit or scope of the invention. Particularly, it should be understood that the present invention may be embodied in the following forms.

The ring plate 45 of the first embodiment may include only one of the abutment portions 53*a* and 53*b*. In the same manner, the ring plate 45 of the second embodiment may include only one of the abutment portions 57*a* and 57*b*.

In the control mechanism 15, the control valve 15*c* may be arranged in the gas supplying passage 15*b*, and the orifice 15*d* may be arranged in the bleed passage 15*a*. In this case, the control valve 15*c* allows for adjustment of the open degree of the gas supplying passage 15*b*. This enables the control pressure chamber 13*c* to be promptly increased to a high pressure by the pressure of the refrigerant gas in the second discharge chamber thereby promptly increasing the compressor displacement.

The present examples and embodiments are to be considered as illustrative and not restrictive, and the invention is not to be limited to the details given herein, but may be modified within the scope and equivalence of the appended claims.

What is claimed is:

1. A variable displacement swash plate compressor comprising:

a housing including a suction chamber, a discharge chamber, a swash plate chamber, and a cylinder bore;

a drive shaft rotationally supported by the housing;

a swash plate that is rotatable together with the drive shaft in the swash plate chamber;

a link arranged between the drive shaft and the swash plate, wherein the link includes a supporting portion that pivotally supports the swash plate, and the link allows for changes in an inclination angle of the swash plate relative to a plane orthogonal to an axis of the drive shaft;

a piston reciprocally accommodated in the cylinder bore;

a converter that is configured to reciprocate the piston in the cylinder bore with a stroke that is in accordance with the inclination angle of the swash plate when the swash plate rotates;

an actuator located in the swash plate chamber, wherein the actuator is capable of changing the inclination angle of the swash plate; and a controller that is configured to control the actuator; wherein the actuator includes a partitioning body arranged on the drive shaft, wherein the partitioning body is movable along the axis of the drive shaft, a movable body arranged on the drive shaft, wherein the movable body includes a coupling portion coupled to the swash plate, and the movable body moves in contact with the partitioning body along the axis of the drive shaft to change the inclination angle of the swash plate, and a control pressure chamber defined by the partitioning body and the movable body, wherein the movable body is moved by drawing refrigerant in the control pressure chamber from the discharge chamber, the swash plate is configured to contact and move the partitioning body as the inclination angle of the swash plate increases, and the movable body is configured to move relative to the partitioning body.

2. The variable displacement swash plate compressor according to claim 1, wherein the coupling portion and the supporting portion are located at opposite sides of a center of the swash plate.

3. The variable displacement swash plate compressor according to claim 2, wherein the swash plate includes an abutment portion that contacts the partitioning body, the abutment portion is located at a position separated from the center of the swash plate toward the coupling portion, and the abutment portion contacts the partitioning body when the inclination angle of the swash plate changes from a predetermined inclination angle, which is between a minimum inclination angle and a maximum inclination angle, to the maximum inclination angle.

4. The variable displacement swash plate compressor according to claim 3, wherein the abutment portion is located between the coupling portion and the supporting portion.

5. The variable displacement swash plate compressor according to claim 1, further comprising a movement amount restriction portion located in the control pressure chamber, wherein the movement amount restriction portion restricts a movement amount of the partitioning body.

6. The variable displacement swash plate compressor according to claim 1, wherein the swash plate includes a ring plate and an abutment portion that projects from the ring plate in a rearward direction, and the abutment portion is configured to contact and move the partitioning body as the inclination angle of the swash plate increases.

7. The variable displacement swash plate compressor according to claim 1, wherein a volume of the control pressure chamber when the inclination angle of the swash plate is at a maximum inclination angle is greater than a volume of the control pressure chamber when the inclination angle of the swash plate is at a minimum inclination angle.

8. The variable displacement swash plate compressor according to claim 1, wherein the inclination angle of the swash plate increases upon an increase in a pressure of the control pressure chamber.

* * * * *